US009842568B2

(12) United States Patent
Lee et al.

(10) Patent No.: US 9,842,568 B2
(45) Date of Patent: Dec. 12, 2017

(54) DEVICE FOR CONTROLLING COLOR GAMUT AND DISPLAY DEVICE INCLUDING THE SAME

(71) Applicant: SAMSUNG DISPLAY CO., LTD., Yongin, Gyeonggi-Do (KR)

(72) Inventors: Min-Tak Lee, Yongin (KR); Kyu-Seok Kim, Yongin (KR); Young-Nam Yun, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 383 days.

(21) Appl. No.: 14/531,895

(22) Filed: Nov. 3, 2014

(65) Prior Publication Data

US 2015/0123986 A1 May 7, 2015

(30) Foreign Application Priority Data

Nov. 4, 2013 (KR) ..... 10-2013-0132981

(51) Int. Cl.
*G09G 5/02* (2006.01)
*G09G 3/20* (2006.01)

(52) U.S. Cl.
CPC ..... *G09G 5/02* (2013.01); *G09G 3/20* (2013.01); *G09G 2320/0242* (2013.01);
(Continued)

(58) Field of Classification Search
None
See application file for complete search history.

(56) References Cited

U.S. PATENT DOCUMENTS 8,463,067 B2 6/2013 Kim et al.
2003/0117714 A1* 6/2003 Nakamura ..... H04N 9/3147 359/649

(Continued)

FOREIGN PATENT DOCUMENTS

KR 10-2008-0034690 4/2008
KR 10-2008-0064324 7/2008
KR 10-2009-0077184 7/2009

OTHER PUBLICATIONS

Stone, "Completely Painless Programmer's Guide to XYZ, RGB, ICC, xyY, and TRCs," Oct. 2013, retrieved on Dec. 5, 2016 from http://web.archive.org/web/20131013213435/http://ninedegreesbelow.com/photography/xyzrgb.html.*
Stone, "The Luminance of an sRGB Color," Oct. 2013, retrieved on Dec. 1, 2016 from http://ninedegreesbelow.com/photography/srgbluminance.html.*

(Continued)

*Primary Examiner* — Ryan D McCulley
(74) *Attorney, Agent, or Firm* — Lewis Roca Rothgerber Christie LLP

(57) ABSTRACT

A color gamut controlling device and a display device including the color gamut controlling device. The color gamut controlling device includes a light sensing unit, a first calculation unit, a second calculation unit, and a color gamut calculation unit. The light sensing unit measures a luminance of external light. The first calculation unit calculates adjusted tristimulus values for each of three primary colors based on the measured luminance. The second calculation unit calculates final tristimulus values for each of the three primary colors using the adjusted tristimulus values and target tristimulus values for each of the three primary colors. The color gamut calculation unit calculates a corrected color gamut from the final tristimulus values. The light sensing unit may further measure tristimulus values of the external light for each of the three primary colors.

18 Claims, 3 Drawing Sheets

(52) U.S. Cl.
CPC . *G09G 2320/0666* (2013.01); *G09G 2320/08* (2013.01); *G09G 2360/144* (2013.01)

(56) References Cited

U.S. PATENT DOCUMENTS

| | | | | |
|---|---|---|---|---|
| 2005/0030538 | A1* | 2/2005 | Jaffar | G01J 1/32 356/405 |
| 2008/0165292 | A1* | 7/2008 | Bing | H04N 9/3194 348/744 |
| 2010/0073340 | A1 | 3/2010 | Morimoto | |
| 2010/0207531 | A1* | 8/2010 | Peker | H05B 33/086 315/152 |
| 2011/0141159 | A1 | 6/2011 | Takeuchi | |
| 2012/0113162 | A1 | 5/2012 | Seetzen | |
| 2012/0268437 | A1* | 10/2012 | Lee | G09G 3/20 345/207 |
| 2014/0043354 | A1* | 2/2014 | Choi | G09G 5/02 345/590 |
| 2014/0104297 | A1* | 4/2014 | Yang | G06T 11/001 345/589 |
| 2014/0198084 | A1* | 7/2014 | Peana | G09G 3/3406 345/207 |
| 2014/0210802 | A1* | 7/2014 | Myers | G09G 3/3413 345/207 |

OTHER PUBLICATIONS

EPO Search Report dated Jan. 7, 2015, for corresponding European Patent application 14191431.7, (7 pages).

* cited by examiner

DEVICE FOR CONTROLLING COLOR GAMUT AND DISPLAY DEVICE INCLUDING THE SAME

CROSS-REFERENCE TO RELATED APPLICATION

This application claims priority to and the benefit of Korean Patent Application No. 10-2013-0132981, filed on Nov. 4, 2013 in the Korean Intellectual Property Office, the entire content of which is incorporated herein by reference.

BACKGROUND

1. Field

Aspects of embodiments of the present invention relate to a color gamut controlling device and a display device including the same.

2. Description of the Related Art

Recently, various types of display devices having reduced weight and volume compared to those of cathode ray tube devices have been developed. The display devices include liquid crystal display devices, field emission display devices, plasma display devices, organic light emitting display devices, and the like. Among these display devices, organic light emitting display devices display images using organic light emitting diodes that emit light through recombination of electrons and holes. Organic light emitting display devices have fast response times and are driven with low power consumption. Hence, organic light emitting display devices have come into the spotlight as next-generation display devices. Such display devices are used as display screens of personal portable terminals such as digital cameras, camcorders, cellular phones, personal digital assistants (PDAs), and notebook computers as well as televisions (TVs).

SUMMARY

In an embodiment of the present invention, a color gamut controlling device is provided. The color gamut controlling device includes a light sensing unit configured to measure a luminance of external light, a first calculation unit configured to calculate adjusted tristimulus values for each of three primary colors based on the measured luminance, a second calculation unit configured to calculate final tristimulus values for each of the three primary colors using the adjusted tristimulus values and target tristimulus values for each of the three primary colors, and a color gamut calculation unit configured to calculate a corrected color gamut from the final tristimulus values.

The second calculation unit may be further configured to calculate the final tristimulus values by subtracting the adjusted tristimulus values from the target tristimulus values for each of the three primary colors.

The adjusted tristimulus values may have a proportional relationship to the measured luminance.

The light sensing unit may be further configured to measure tristimulus values of the external light for each of the three primary colors.

The first calculation unit may be further configured to calculate the adjusted tristimulus values for each of the three primary colors based on the measured tristimulus values.

The adjusted tristimulus values may have a proportional relationship to the measured luminance and to corresponding ones of the measured tristimulus values.

A display device may include the color gamut controlling device.

The color gamut controlling device may further include a third calculation unit configured to calculate the target tristimulus values using x and y chromaticities of a reference color gamut for each of the three primary colors and a reference luminance for each of the three primary colors.

The reference color gamut may be an sRGB standard color gamut.

A ratio of red said reference luminance, green said reference luminance, and blue said reference luminance may be 21.3:71.5:7.2.

The third calculation unit may be further configured to calculate red said target tristimulus values from $Xr=xr*Yr/yr$, $Yr=Lr$, and $Zr=Xr/xr-Xr-Yr$, where Xr, Yr, and Zr are the red target tristimulus values, xr and yr are red said x and y chromaticities of the reference color gamut, and Lr is red said reference luminance.

The third calculation unit may be further configured to calculate green said target tristimulus values from $Xg=xg*Yg/yg$, $Yg=Lg$, and $Zg=Xg/xg-Xg-Yg$, where Xg, Yg, and Zg are the green target tristimulus values, xg and yg are green said x and y chromaticities of the reference color gamut, and Lg is green said reference luminance.

The third calculation unit may be further configured to calculate blue said target tristimulus values from $Xb=xb*Yb/yb$, $Yb=Lb$, and $Zb=Xb/xb-Xb-Yb$, where Xb, Yb, and Zb are the blue target tristimulus values, xb and yb are blue said x and y chromaticities of the reference color gamut, and Lb is blue said reference luminance.

A display device may include the color gamut controlling device.

The color gamut calculation unit may be further configured to calculate the corrected color gamut by calculating final x and y chromaticities for each of the three primary colors from the final tristimulus values.

The color gamut calculation unit may be further configured to calculate red said final x and y chromaticities from $x''r=X''r/(X''r+Y''r+Z''r)$, and $y''r=Y''r/(X''r+Y''r+Z''r)$, where x"r and y"r are the red final x and y chromaticities, and X"r, Y"r, and Z"r are red said final tristimulus values.

The color gamut calculation unit may be further configured to calculate green said final x and y chromaticities from $x''g=X''g/(X''g+Y''g+Z''g)$, and $y''g=Y''g/(X''g+Y''g+Z''g)$, where x"g and y"g are the green final x and y chromaticities, and X"g, Y"g, and Z"g are green said final tristimulus values.

The color gamut calculation unit may be further configured to calculate blue said final x and y chromaticities from $x''b=X''b/(X''b+Y''b+Z''b)$, and $y''b=Y''b/(X''b+Y''b+Z''b)$, where x"b and y"b are the blue final x and y chromaticities, and X"b, Y"b, and Z"b are blue said final tristimulus values.

A display device may include the color gamut controlling device.

BRIEF DESCRIPTION OF THE DRAWINGS

Example embodiments will now be described more fully hereinafter with reference to the accompanying drawings; however, the present invention may be embodied in different forms and should not be construed as limited to the embodiments set forth herein. Rather, these embodiments are provided to more fully convey the scope of the present invention to those skilled in the art.

In the drawings, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

In the following detailed description, example embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

Figure 1:
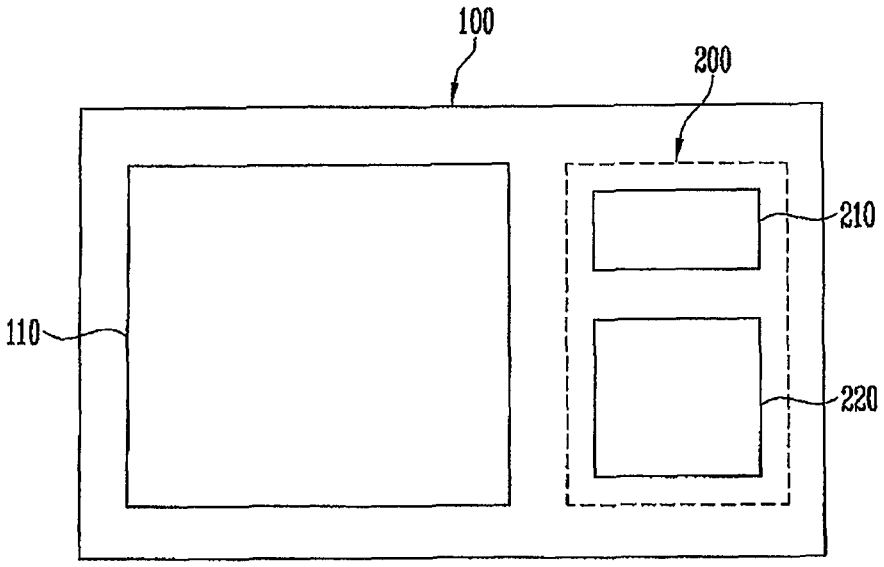
FIG. 1 is a block diagram illustrating a display device according to an embodiment of the present invention.

FIG. 1 is a block diagram illustrating a display device 100 according to an embodiment of the present invention.

Referring to FIG. 1, the display device 100 includes a display unit 110 and a color gamut controlling device 200. The display unit 110 may display a set or predetermined image using a plurality of pixels. In addition, the display unit 110 may display an image based on a corrected color gamut Gc calculated in the color gamut controlling device 200.

The color gamut controlling device 200 may control the color gamut by recognizing a change in the ambient environment. To this end, the color gamut controlling device 200 includes a light sensing unit 210 configured to sense external light, and a color gamut control unit 220 configured to change the color gamut according to properties of the light sensed by the light sensing unit 210.

Figure 2:
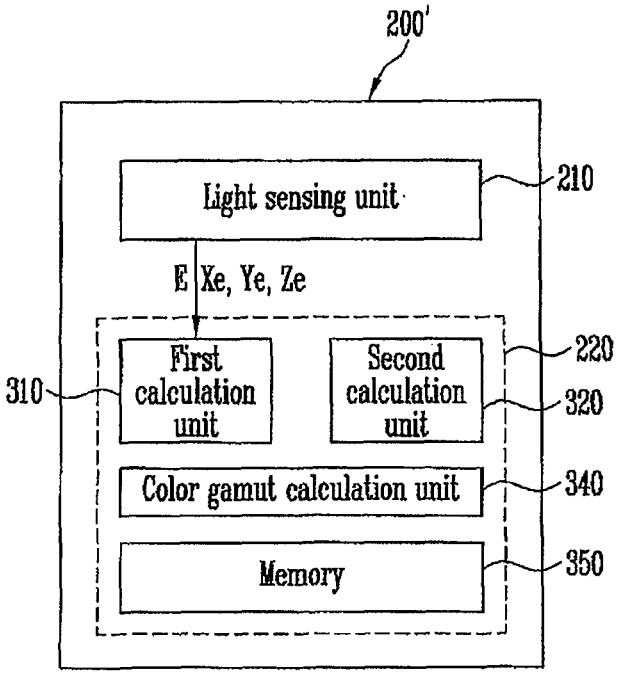
FIG. 2 is a block diagram illustrating a color gamut controlling device according to a first embodiment of the present invention.

FIG. 2 is a block diagram illustrating a color gamut controlling device 200' according to a first embodiment of the present invention.

Referring to FIG. 2, the color gamut controlling device 200' includes a light sensing unit 210, a first calculation unit 310, a second calculation unit 320, and a color gamut calculation unit 340. The light sensing unit 210 may sense external light, for example, to measure the luminance of the external light. The light sensing unit 210 may additionally measure tristimulus values of the external light for each of three primary colors (e.g., primary colors red, green, and blue). The light sensing unit 210 may supply the measured luminance E of the external light and the measured tristimulus values Xe, Ye, and Ze of the external light to the first calculation unit 310.

The first calculation unit 310 may calculate adjusted tristimulus values X', Y', and Z' for each of the three primary colors based on the measured luminance E of the external light. For example, the adjusted tristimulus values X', Y', and Z' may have a proportional relationship to the measured luminance E of the external light. Thus, as the luminance E of the external light is increased, the adjusted tristimulus values X', Y', and Z' may be increased (for example, in proportion to the increase in the luminance E).

For example, the adjusted tristimulus values X', Y', and Z' may be calculated through the following sets of equations:

$$X'r=A*Xe_r*E, Y'r=A*Ye_r*E, Z'r=A*Ze_r*E,$$

$$X'g=A*Xe_g*E, Y'g=A*Ye_g*E, Zg=A*Ze_g*E,$$

$$X'b=A*Xe_b*E, Y'b=A*Ye_b*E, Z'b=A*Ze_b*E.$$

Here, X'r, Y'r, and Z'r are the adjusted red tristimulus values, X'g, Y'g, and Z'g are the adjusted green tristimulus values, X'b, Y'b, and Z'b are the adjusted blue tristimulus values, A is a constant, Xe_r, Ye_r, and Ze_r are the measured red tristimulus values of the external light, Xe_g, Ye_g, and Ze_g are the measured green tristimulus values of the external light, Xe_b, Ye_b, and Ze_b are the measured blue tristimulus values of the external light, and E is the measured luminance of the external light.

Using these equations, the first calculation unit 310 may calculate the adjusted tristimulus values X', Y', and Z' based on the measured tristimulus values Xe, Ye, and Ze of the external light as well as the measured luminance E of the external light. Thus, the adjusted tristimulus values X', Y', and Z' may have a proportional relationship to the measured luminance E and to corresponding ones of the measured tristimulus values Xe, Ye, and Ze of the external light. Accordingly, the measured tristimulus values Xe, Ye, and Ze of the external light may be processed as relative sizes with respect to a specific stimulus (e.g., Ye) to be used for calculating the adjusted tristimulus values X', Y', and Z'.

In the above equations, the constant A may be experimentally calculated. For example, the constant A may be determined based on a reflexibility of the display device 100 caused by the external light. In this case, the reflexibility of the display device 100 may be used by a specular component included (SCI) method, etc.

The second calculation unit 320 may calculate final tristimulus values X", Y", and Z" for each of the three primary colors using the adjusted tristimulus values X', Y', and Z' for each of the three primary colors calculated by the first calculation unit 310, and target tristimulus values X, Y, and Z set or predetermined for each of the three primary colors. For example, the second calculation unit 320 may calculate the final tristimulus values X", Y", and Z" by subtracting the adjusted tristimulus values X', Y', and Z' from the target tristimulus values X, Y, and Z for each of the three primary colors. In this case, the final tristimulus values X", Y", and Z" may be calculated through the following equations:

$$X''=X-X',\ Y''=Y-Y',\ Z''=Z-Z'.$$

More specifically, the final tristimulus values X", Y", and Z" for each of the three primary colors may be expressed by the following equations:

$$X''r=Xr-X'r, Y''r=Yr-Y'r, Z''r=Zr-Z'r,$$

$$X''g=Xg-X'g, Y''g=Yg-Y'g, Z''g=Zg-Z'g,$$

$$X''b=Xb-X'b, Y''b=Yb-Y'b, Z''b=Zb-Z'b.$$

Here, X"r, Y"r, and Z"r are the final red tristimulus values, X"g, Y"g, and Z"g are the final green tristimulus values, X"b, Y"b, and Z"b are the final blue tristimulus values, Xr, Yr, and Zr are the target red tristimulus values, Xg, Yg, and Zg are the target green tristimulus values, Xb, Yb, and Zb are the target blue tristimulus values, X'r, Y'r, and Z'r are the adjusted red tristimulus values, X'g, Y'g, and Z'g are the adjusted green tristimulus values, and X'b, Yb, and Z'b are the adjusted blue tristimulus values.

In order to store, for example, the target tristimulus values X, Y, and Z used for calculating the final tristimulus values X", Y", and Z", the color gamut controlling device 200' may further include a memory 350. Thus, the second calculation unit 320 may retrieve the target tristimulus values X, Y, and Z stored in the memory 350 to calculate the final tristimulus values X", Y", and Z".

Figure 3:
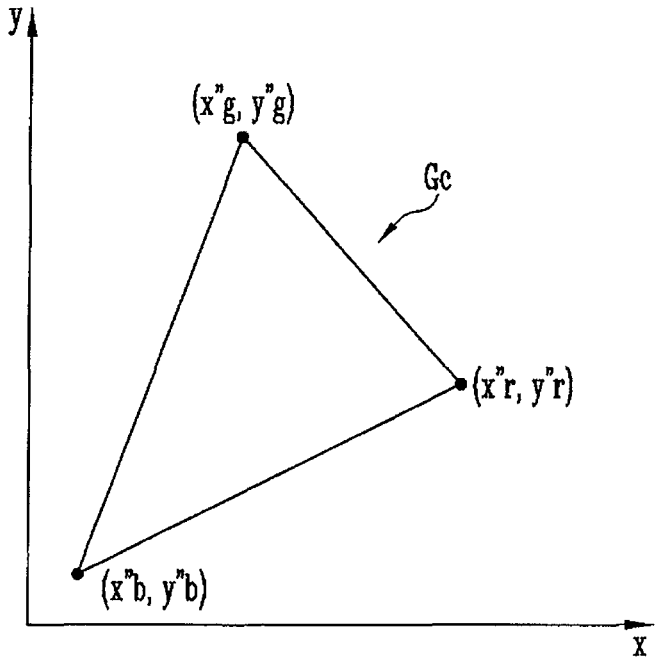
FIG. 3 is a graph illustrating a corrected color gamut according to an embodiment of the present invention.

FIG. 3 is a graph illustrating a corrected color gamut according to an embodiment of the present invention.

The color gamut calculation unit 340 may calculate a corrected color gamut Gc from the final tristimulus values X", Y", and Z" calculated by the second calculation unit 320. To this end, the color gamut calculation unit 340 may calculate final x and y chromaticities x" and y" for each of the three primary colors using the final tristimulus values X", Y", and Z".

For example, the color gamut calculation unit 340 may calculate the final x and y chromaticities x" and y" through the following equations:

$$x''r=X''r/(X''r+Y''r+Z''r),y''r=Y''r/(X''r+Y''r+Z''r),$$

$$x''g=X''g/(X''g+Y''g+Z''g),y''g=Y''g/(X''g+Y''g+Z''g)$$

$$x''b=X''b/(X''b+Y''b+Z''b),y''b=Y''b/(X''b+Y''b+Z''b).$$

Here, x"r and y"r are the final red x and y chromaticities, x"g and y"g are the final green x and y chromaticities, x"b and y"b are the final blue x and y chromaticities, X"r, Y"r, and Z"r are the final red tristimulus values, X"g, Y"g, and Z"g are the final green tristimulus values, and X"b, Y"b, and Z"b are the final blue tristimulus values.

Accordingly, the color gamut calculation unit 340 may calculate a corrected color gamut Gc defined by the final red x and y chromaticities x"r and y"r, the final green x and y chromaticities x"g and y"g, and the final blue x and y chromaticities x"b and y"b. Thus, the display device 100 can display an image based on the corrected color gamut Gc calculated by the color gamut calculation unit 340.

Figure 4:
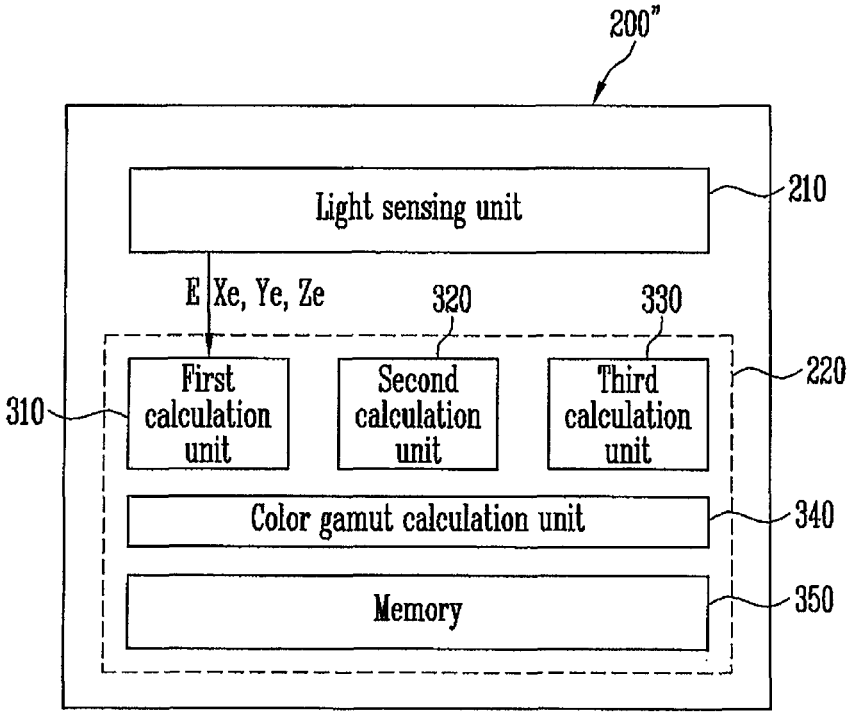
FIG. 4 is a block diagram illustrating a color gamut controlling device according to a second embodiment of the present invention.
Figure 5:
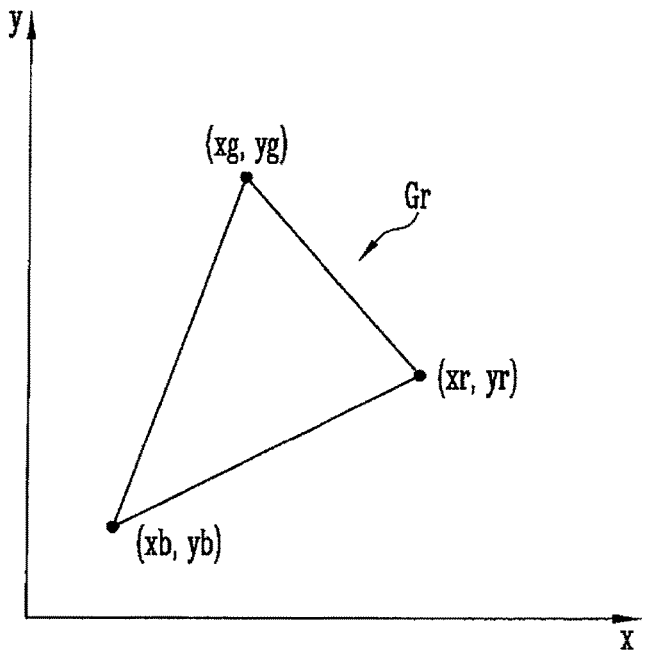
FIG. 5 is a graph illustrating a reference color gamut according to an embodiment of the present invention.

FIG. 4 is a block diagram illustrating a color gamut controlling device according to a second embodiment of the present invention. FIG. 5 is a graph illustrating a reference color gamut according to an embodiment of the present invention.

Referring to FIG. 4, the color gamut controlling device 200" includes a light sensing unit 210, a first calculation unit 310, a second calculation unit 320, a third calculation unit 330, and a color gamut calculation unit 340. Thus, when comparing the second embodiment with the first embodiment, the color gamut controlling device 200" further includes the third calculation unit 330. Therefore, the third calculation unit 330 will be mainly described in the second embodiment, and descriptions of portions overlapping with those of the aforementioned embodiment will not be repeated.

Referring to FIGS. 4 and 5, the third calculation unit 330 may calculate target tristimulus values X, Y, and Z using x and y chromaticities of the reference color gamut Gr for each of the three primary colors and a reference luminance L set or predetermined for each of the three primary colors. For example, the reference luminance L may include a red reference luminance Lr, a green reference luminance Lg, and a blue reference luminance Lb. The third calculation unit 330 may store the calculated target tristimulus values X, Y, and Z in a memory 350. Information on the reference color gamut Gr and the reference luminance L may be stored in the memory 350, or may be received from outside the color gamut controlling device 200".

For example, the third calculation unit 330 may calculate target tristimulus values X, Y, and Z through the following equations:

$$Xr=xr*Yr/yr,Yr=Lr,Zr=Xr/xr-Xr-Yr,$$

$$Xg=xg*Yg/yg,Yg=Lg,Zg=Xg/xg-Xg-Yg,$$

$$Xb=xb*Yb/yb,Yb=Lb,Zb=Xb/xb-Xb-Yb.$$

Here, Xr, Yr, and Zr are the target red tristimulus values, Xg, Yg, and Zg are the target green tristimulus values, Xb, Yb, and Zb are the target blue tristimulus values, xr and yr are the red x and y chromaticities of the reference color gamut Gr, xg and yg are the green x and y chromaticities of the reference color gamut Gr, xb and yb are blue x and y chromaticities of the reference color gamut Gr, Lr is the red reference luminance, Lg is the green reference luminance, and Lb is the blue reference luminance.

In this case, the reference color gamut Gr may be set, for example, to an sRGB standard color gamut. Therefore, the red x and y chromaticities xr and yr may be respectively set to 0.64 and 0.34, the green x and y chromaticities xg and yg may be respectively set to 0.30 and 0.60, and the blue x and y chromaticities xb and yb may be respectively set to 0.15 and 0.06.

In the sRGB standard color gamut, the luminance ratio of the red, the green, and the blue is set to 21.3:71.5:7.2. Therefore, the ratio of the red reference luminance Lr, the green reference luminance Lg, and the blue reference luminance Lb may be set to 21.3:71.5:7.2. The third calculation unit 330 is provided as described above so that the target tristimulus values X, Y, and Z can be changed.

By way of summation and review, personal portable terminals are mobile and have display screens that enable users to watch their desired contents anywhere and anytime. In addition, these display screens are exposed to various ambient environments due to this portability and mobility.

However, ambient factors such as luminance affect the images displayed on these display screens. This may cause the same image to be viewed differently depending on the ambient environment. For example, if the ambient luminance is much higher than the brightness of the display screen (such as on a clear day), the visibility of the image displayed on the display screen is rapidly lowered. Factors such as the lowering of the visibility may offset some of the features of the personal portable terminals.

Accordingly, it may be desired to maintain the visibility of an image displayed on the display screen even though the ambient environment is changed. For example, it may be desired to maintain the visibility of an image in an ambient environment of high luminance. As described above, according to embodiments of the present invention, it is possible to provide a color gamut controlling device and a display device including the color gamut controlling device, in which the color gamut is changed depending on an ambient environment, thereby improving visibility.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. A color gamut controlling device coupled to a display panel, the color gamut controlling device comprising:

a light sensor configured to measure a luminance of external ambient light;

a first calculation unit configured to calculate adjusted tristimulus values for each of three primary colors based on the measured luminance of the external ambient light;

a second calculation unit configured to calculate final tristimulus values for each of the three primary colors using the adjusted tristimulus values and target tristimulus values for each of the three primary colors; and a color gamut calculation unit configured to define a corrected color gamut from the final tristimulus values to correct an image to be displayed, wherein the color gamut calculation unit is further configured to define the corrected color gamut by calculating final x and y chromaticities for each of the three primary colors from the final tristimulus values, and wherein the display panel is configured to display the corrected image based on the corrected color gamut.

2. The color gamut controlling device of claim 1, wherein the second calculation unit is further configured to calculate the final tristimulus values by subtracting the adjusted tristimulus values from the target tristimulus values for each of the three primary colors.

3. The color gamut controlling device of claim 1, wherein the adjusted tristimulus values have a proportional relationship to the measured luminance.

4. The color gamut controlling device of claim 1, wherein the light sensor is further configured to measure tristimulus values of the external light for each of the three primary colors.

5. The color gamut controlling device of claim 4, wherein the first calculation unit is further configured to calculate the adjusted tristimulus values for each of the three primary colors based on the measured tristimulus values.

6. The color gamut controlling device of claim 5, wherein the adjusted tristimulus values have a proportional relationship to the measured luminance and to corresponding ones of the measured tristimulus values.

7. A display device comprising the color gamut controlling device of claim 4.

8. The color gamut controlling device of claim 1, further comprising a third calculation unit configured to calculate the target tristimulus values using x and y chromaticities of a reference color gamut for each of the three primary colors and a reference luminance for each of the three primary colors.

9. The color gamut controlling device of claim 8, wherein the reference color gamut is an sRGB standard color gamut.

10. The color gamut controlling device of claim 9, wherein a ratio of red said reference luminance, green said reference luminance, and blue said reference luminance is 21.3:71.5:7.2.

11. The color gamut controlling device of claim 8, wherein the third calculation unit is further configured to calculate red said target tristimulus values from:

$$Xr=xr*Yr/yr;$$

$$Yr=Lr; \text{ and}$$

$$Zr=Xr/xr-Xr-Yr,$$

wherein Xr, Yr, and Zr are the red target tristimulus values, xr and yr are red said x and y chromaticities of the reference color gamut, and Lr is red said reference luminance.

12. The color gamut controlling device of claim 11, wherein the third calculation unit is further configured to calculate green said target tristimulus values from:

$$Xg=xg*Yg/yg;$$

$$Yg=Lg; \text{ and}$$

$$Zg=Xg/xg-Xg-Yg,$$

wherein Xg, Yg, and Zg are the green target tristimulus values, xg and yg are green said x and y chromaticities of the reference color gamut, and Lg is green said reference luminance.

13. The color gamut controlling device of claim 12, wherein the third calculation unit is further configured to calculate blue said target tristimulus values from:

$$Xb=xb*Yb/yb;$$

$$Yb=Lb; \text{ and}$$

$$Zb=Xb/xb-Xb-Yb,$$

wherein Xb, Yb, and Zb are the blue target tristimulus values, xb and yb are blue said x and y chromaticities of the reference color gamut, and Lb is blue said reference luminance.

14. A display device comprising the color gamut controlling device of claim 8.

15. The color gamut controlling device of claim 1, wherein the color gamut calculation unit is further configured to calculate red said final x and y chromaticities from:

$$x''r=X''r/(X''r+Y''r+Z''r); \text{ and}$$

$$y''r=Y''r/(X''r+Y''r+Z''r),$$

wherein x"r and y"r are the red final x and y chromaticities, and X"r, Y"r, and Z"r are red said final tristimulus values.

16. The color gamut controlling device of claim 15, wherein the color gamut calculation unit is further configured to calculate green said final x and y chromaticities from:

$$x''g=X''g/(X''g+Y''g+Z''g); \text{ and}$$

$$y''g=Y''g/(X''g+Y''g+Z''g),$$

wherein x"g and y"g are the green final x and y chromaticities, and X"g, Y"g, and Z"g are green said final tristimulus values.

17. The color gamut controlling device of claim 16, wherein the color gamut calculation unit is further configured to calculate blue said final x and y chromaticities from:

$$x''b=X''b/(X''b+Y''b+Z''b);\text{ and}$$

$$y''b=Y''b/(X''b+Y''b+Z''b),$$

wherein x"b and y"b are the blue final x and y chromaticities, and X"b, Y"b, and Z"b are blue said final tristimulus values.

18. A display device comprising the color gamut controlling device of claim 1.

* * * * *